United States Patent [19]

Wazaki et al.

[11] Patent Number: 4,751,650

[45] Date of Patent: Jun. 14, 1988

[54] FUEL SUPPLY CONTROL METHOD FOR INTERNAL COMBUSTION ENGINES IN HIGH LOAD OPERATING CONDITIONS

[75] Inventors: Yoshio Wazaki; Yuzuru Koike; Akihiko Koike, all of Utsunomiya, Japan

[73] Assignee: Honda Giken Kogyo K.K., Tokyo, Japan

[21] Appl. No.: 785,786

[22] Filed: Oct. 9, 1985

[30] Foreign Application Priority Data

Oct. 11, 1984 [JP] Japan ..... 59-211281

[51] Int. Cl.[4] ..... F02B 3/00

[52] U.S. Cl. ..... 364/431.05; 364/431.03; 123/492

[58] Field of Search ..... 364/431.03, 431.05, 364/431.07, 431.08, 431.09; 123/425, 435, 492, 480, 417, 179 G, 339

[56] References Cited

U.S. PATENT DOCUMENTS

| | | | |
|---|---|---|---|
| 4,385,596 | 5/1983 | Hosaka | 123/491 |
| 4,471,742 | 9/1984 | Kishi | 123/480 |
| 4,503,829 | 3/1985 | Hasegawa et al. | 123/492 |
| 4,510,911 | 4/1985 | Otobe | 123/492 |
| 4,513,713 | 4/1985 | Koumura et al. | 123/339 |
| 4,513,723 | 4/1985 | Ishikawa et al. | 123/492 |
| 4,562,819 | 1/1986 | Kobayashi et al. | 123/179 G |
| 4,590,564 | 5/1986 | Ishikawa et al. | 364/431.07 |
| 4,639,870 | 1/1987 | Otobe et al. | 364/431.05 |

*Primary Examiner*—Parshotam S. Lall
*Assistant Examiner*—V. N. Trans
*Attorney, Agent, or Firm*—Arthur L. Lessler

[57] ABSTRACT

A method of controlling the fuel supply to an internal combustion engine in response to operating conditions thereof. First and second groups of basic fuel quantity values are set beforehand as a function of a first engine operation parameter including at least the engine rotational speed, the basic fuel quantity values of the second group being each larger than a corresponding one of those of the first group for the same first engine operation parameter value. When it is determined from a detected second engine operation parameter value indicative of engine load that the engine is operating in a predetermined high load condition, one basic fuel quantity value of the second group is selected that corresponds to a detected first engine operation parameter value, and corrected by a fuel increment based upon a detected engine temperature value and the detected second engine operation parameter value. A fuel quantity is set on the basis of the corrected one basic fuel quantity and supplied to the engine. When the engine is determined to be operating in a condition other than the predetermined high load condition, one basic fuel quantity value of the first group is selected that corresponds to the detected first engine operation parameter value, to set, on the basis thereof, a fuel quantity for supply to the engine.

4 Claims, 5 Drawing Sheets

FUEL INJECTION VALVE
6
INTERNAL COMBUSTION ENGINE
1
Ne
10
Tw
9
ECU
5
2
7
PBA
8
3
4
θTH
11

FIG. 6

| Ne \ $P_{BA}$ | $P_{BA1}$ | --- | $P_{BAj}$ | --- | $P_{BA9}$ |
|---|---|---|---|---|---|
| $N_1$ | $T_{111}$ | | | | |
| ⋮ | | | | | |
| $N_i$ | | | $T_{1ij}$ | | |
| ⋮ | | | | | |
| $N_9$ | | | | | $T_{199}$ |

FIG. 7

| Ne \ $P_{BA}$ | $P_{BA1}$ | --- | $P_{BAj}$ | --- | $P_{BA9}$ |
|---|---|---|---|---|---|
| $N_1$ | $T_{211}$ | | | | |
| ⋮ | | | | | |
| $N_i$ | | | $T_{2ij}$ | | |
| ⋮ | | | | | |
| $N_9$ | | | | | $T_{299}$ |

FUEL SUPPLY CONTROL METHOD FOR INTERNAL COMBUSTION ENGINES IN HIGH LOAD OPERATING CONDITIONS

BACKGROUND OF THE INVENTION

This invention relates to a fuel supply control method for an internal combustion engine, and more particularly to a fuel supply control method of this kind which is adapted to enrich a mixture to be supplied to the engine when the engine is operating in high load regions.

In an internal combustion engine provided with a fuel injection system in general, the valve opening period of fuel injection valves of the system is set to a value obtained by multiplying a basic value Ti read from a basic Ti map based upon absolute pressure within an intake pipe of the engine and engine rotational speed by various correction coefficients appropriate to operating conditions of the engine. When the engine is in a high load operating condition, the air/fuel ratio of a mixture to be supplied to the engine over the whole high load region is set to a certain value (e.g. 12.0) richer than a theoretical air/fuel ratio (14.7) by multiplying the basic value Ti by an enriching coefficient KWOT or by reading a value of the valve opening period of the fuel injection valves read from a WOT (wide-open-throttle) map specially provided for application in high load operation of the engine, to thereby obtain increased engine output required for such high load operation, as proposed by Japanese Provisional patent Publication (Kokai) No. 57-137633.

High load operating regions of an internal combustion engine include a certain region where engine knocking can easily occur. In such knocking-occurring region, the engine often undergoes knocking particularly when the engine temperature is high.

However, according to the above conventional methods, both of engine temperature and engine rotational speed are not taken into consideration in setting the enriching coefficient KWOT and the WOT map. As a result, these conventional methods are unable to prevent the occurrence of engine knocking during operation of the engine in the aforementioned knocking-occurring region while the engine temperature is high.

SUMMARY OF THE INVENTION

It is the object of the invention to provide a fuel supply control method for internal combustion engines, which is capable of positively preventing engine knocking in high load operating regions, to thereby improve the operational stability of the engine operating in such regions.

The present invention provides a method of controlling the fuel quantity to be supplied to an internal combustion engine in response to operating conditions of the engine. The method according to the invention comprises the steps of: (1) setting beforehand a first group of basic fuel quantity values as a function of a first operation parameter of the engine including at least the rotational speed of the engine; (2) setting beforehand a second group of basic fuel quantity values as a function of the first operation parameter of the engine, the basic fuel quantity values of the second group being each larger than a corresponding one of the basic fuel quantity values of the first group for the same value of the first operation parameter of the engine; (3) detecting a value of the first operation parameter of the engine; (4) detecting a value of the temperature of the engine; (5) detecting a value of a second operation parameter of the engine indicative of load on the engine; (6) determining from the detected value of the second operation parameter of the engine whether or not the engine is operating in a predetermined high load condition; (7) when it is determined that the engine is operating in the predetermined high load condition, (7-i) selecting one of the basic fuel quantity values of the second group that corresponds to the detected value of the first operation parameter of the engine, (7-ii) setting a value of a fuel increment on the basis of the detected value of the temperature of the engine and the detected value of the second operation parameter of the engine, (7-iii) correcting the one of the basic fuel quantity values of the second group selected in step (7-i) by the set value of the fuel increment, (7-iv) setting a fuel quantity on the basis of the one of the basic fuel quantity values of the second group corrected in step (7-iii) and supplying the set quantity to the engine; and (8) when it is determined in step (6) that the engine is operating in a condition other than the predetermined high load condition, (8-i) selecting one of the basic fuel quantity values of the first group that corresponds to the detected value of the first operation parameter of the engine, and (8-ii) setting a fuel quantity on the basis of the one of the basic fuel quantity values of the first group selected in step (8-i) and supplying the set quantity to the engine.

The above and other objects, features and advantages of the invention will be more apparent from the ensuing detailed description taken in conjunction with the accompanying drawings.

BRIEF DESCRIPTION OF THE DRAWINGS

FIG. 6 is a basic Ti map for determining a basic value T1ij of the valve opening period TOUT of the fuel injection valves, applicable during normal operation of the engine; and FIG. 7 is a WOT map for determining a basic vlaue T2ij of the valve opening period TOUT of the fuel injection valves, applicable during high load operation of the engine.

DETAILED DESCRIPTION

The present invention will now be described in detail with reference to the drawings showing an embodiment thereof.

Figure 1:
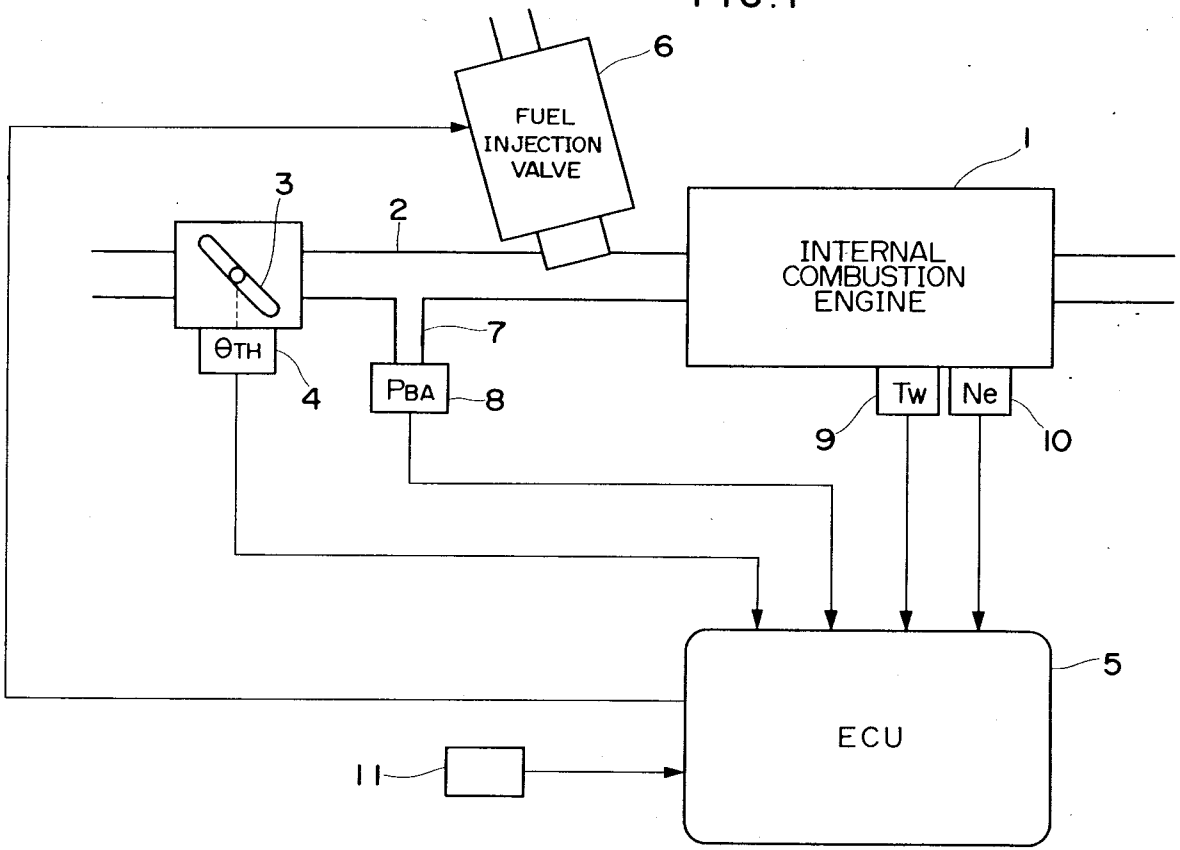
FIG. 1 is a block diagram illustrating the whole arrangement of a fuel supply control system for an internal combustion engine, to which is applied the method of the present invention.

Referring first to FIG. 1, there is illustrated the whole arrangement of a fuel supply control system for internal combustion engines, to which the method according to the invention is applied. Reference numeral 1 designates an internal combustion engine which may be a four-cylinder type, for instance. An intake pipe 2 is connected to the engine 1, in which is arranged a throttle valve 3 which in turn is coupled to a throttle valve opening sensor ($\theta$th sensor) 4 for detecting its valve opening and converting same into an electrical signal which is supplied to an electronic control unit (hereinafter called "the ECU") 5.

Fuel injection valves 6 are arranged in the intake pipe 2 at a location between the engine 1 and the throttle valve 3, which correspond in number to the number of engine cylinders and are each arranged at a location slightly upstream of an intake valve, not shown, of a corresponding engine cylinder. These injection valves 6 are connected to a fuel pump, not shown, and also electrically connected to the ECU 5 in a manner having their valve opening periods or fuel injection quantities controlled by signals supplied from the ECU 5.

On the other hand, an absolute pressure sensor (hereinafter called "the PBA sensor") 8 communicates through a conduit 7 with the interior of the intake pipe at a location downstream of the throttle valve 3. The absolute pressure sensor 8 is adapted to detect absolute pressure in the intake pipe 2 and applies an electrical signal indicative of detected absolute pressure to the ECU 5.

An engine coolant temperature sensor (hereinafter called "TW sensor") 9 which may be formed of a thermistor or the like, is mounted on the main body of the engine 1 in a manner embedded in the peripheral wall of an engine cylinder having its interior filled with cooling water, an electrical output signal of which is supplied to the ECU 5. An engine rotational speed sensor (hereinafter called "the Ne sensor") 10 is arranged in facing relation to a camshaft, not shown, of the engine 1 or a crankshaft of same, not shown. The Ne sensor 10 is adapted to generate one pulse at a particular crank angle of the engine each time the engine crankshaft rotates through 180 degrees, i.e., each pulse of a top-dead-center position (TDC) signal.

Further, other engine operation parameter sensors 11 such as an intake air temperature sensor, an atmospheric pressure sensor and an $O_2$ sensor are electrically connected to the ECU 5, to supply their respective output signals to the ECU 5.

The operation of the fuel supply control system constructed as above will now be described.

The ECU 5 operates in response to engine operation parameter signals from respective sensors as stated above, to determine operating conditions in which the engine is operating, in such as a high load region, etc. and to calculate the valve opening period TOUT of the fuel injection valves 6, which is given by the following equation, in accordance with the determined operating conditions of the engine in syncronism with generation of the TDC signal:

$$TOUT = Ti \times KWOT \times KTW \times K1 + K2 \quad (1)$$

where Ti represents a basic value of the valve opening period of the fuel injection valves 6, which is determined by a basic Ti map applied during normal operation of the engine or by a WOT map applied during high load operation of the engine, as stated hereinafter, KWOT and KTW are an enriching coefficient applied during high load operation of the engine and an engine water temperature-dependent enriching correction coefficient, respectively. The value of the coefficient KWOT is calculated according to the program of FIG. 3 as described later. The value of the coefficient KTW is determined by a KTW table as stated later.

K1 and K2 are correction coefficients and correction variables, respectively, which are calculated on the basis of values of various engine operation parameter signals from the aforementioned various sensors by the use of respective predetermined equations, etc. to such values as to optimize various operating characteristics of the engine such as startability, emission characteristics, fuel consumption characteristic, and accelerability.

The ECU 5 generates driving signals corresponding to the calculated valve opening period TOUT for fuel injection valves 6 to open same.

Figure 2:
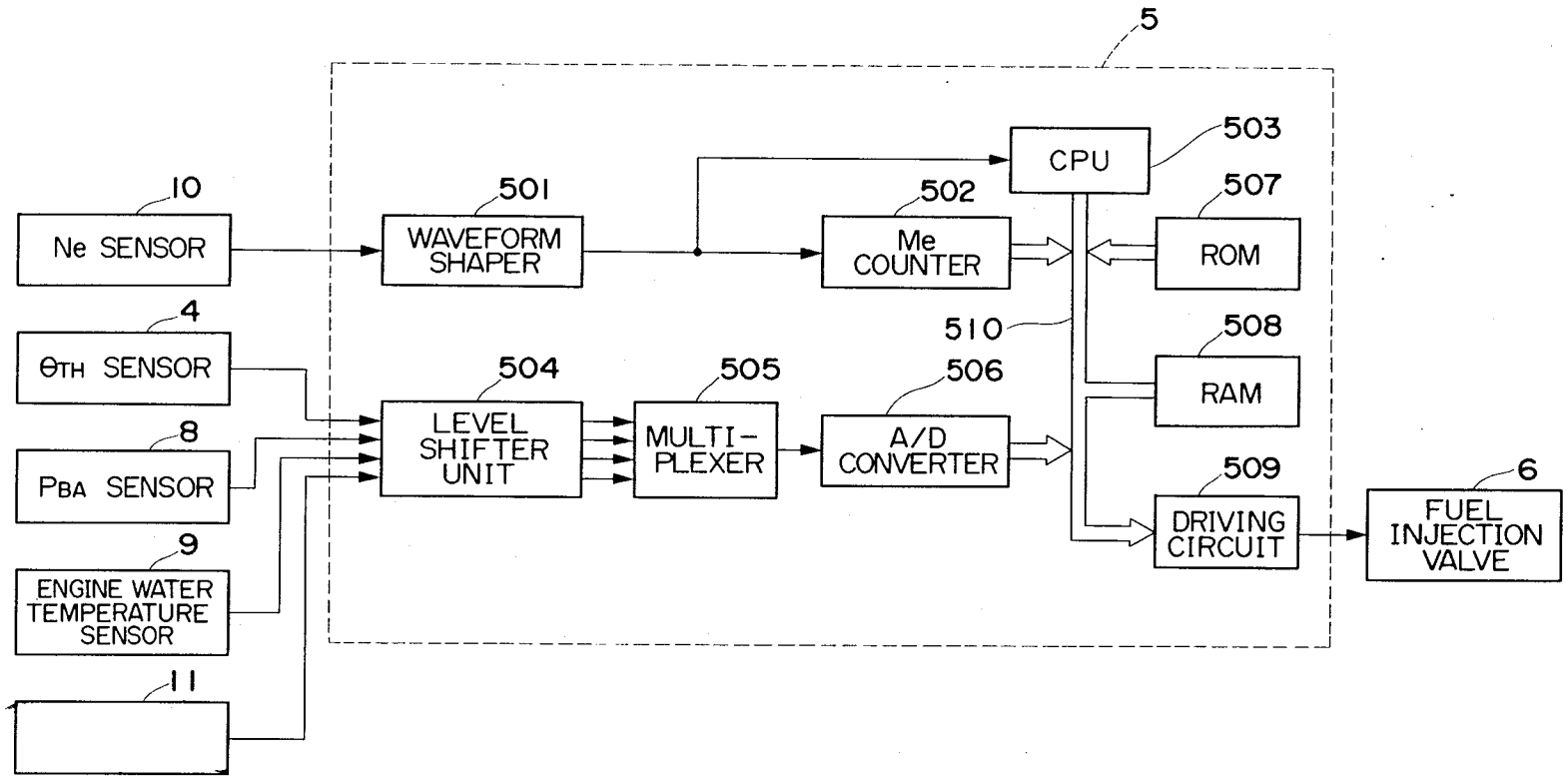
FIG. 2 is a block diagram illustrating the internal arrangement of an electronic control unit (ECU) appearing in FIG. 1.

FIG. 2 shows a circuit configuration within the ECU 5 in FIG. 1. An output signal from the Ne sensor 10 in FIG. 1 is applied to a waveform shaper 501, wherein it has its pulse waveform shaped, and then supplied to a central processing unit (hereinafter called "the CPU") 503, as an interrupt signal for initiating the program of FIG. 3, as well as to an Me value counter 502. The Me value counter 502 counts the interval of time between a preceding pulse of the TDC signal from the Ne sensor 10 and a present pulse of the same signal, and therefore its counted value Me is proportional to the reciprocal of the actual engine rpm Ne. The Me value counter 502 supplies the counted value Me to the CPU 503 via a data bus 510.

The respective output signals from the throttle valve opening sensor 4, the PBA sensor 8, the TW sensor 9, etc., all appearing in FIG. 1, have their voltage levels shifted to a predetermined voltage level by a level shifter unit 504 and successively applied to an analog-to-digital converter 506 through a multiplexer 505. The analog-to-digital converter 506 successively converts analog output voltages from the aforementioned various sensors into respective corresponding digital signals, and the resulting digital signals are supplied to the CPU 503 via the data bus 510.

Further connected to the CPU 503 via the data bus 510 are a read-only memory (hereinafter called "the ROM") 507, a random access memory (hereinafter called "the RAM") 508, and a driving circuit 509. The RAM 508 temporarily stores various calculated values and data from the CPU 503. The ROM 507 stores a control program to be executed within the CPU 503, as states later, as well as the Ti map and the WOT map, referred to before, and also the KTW table, etc. The CPU 503 executes the control program stored in the ROM 507 in response to the various engine operation parameter signals to calculate the fuel injection period of the fuel injection valves 6, and supplies the calculated value of fuel injection period to the driving circuit 509 through the data bus 510. The driving circuit 509 supplies driving signals corresponding to the above calculated TOUT value to the fuel injection valves 6 to drive same.

Figure 3:
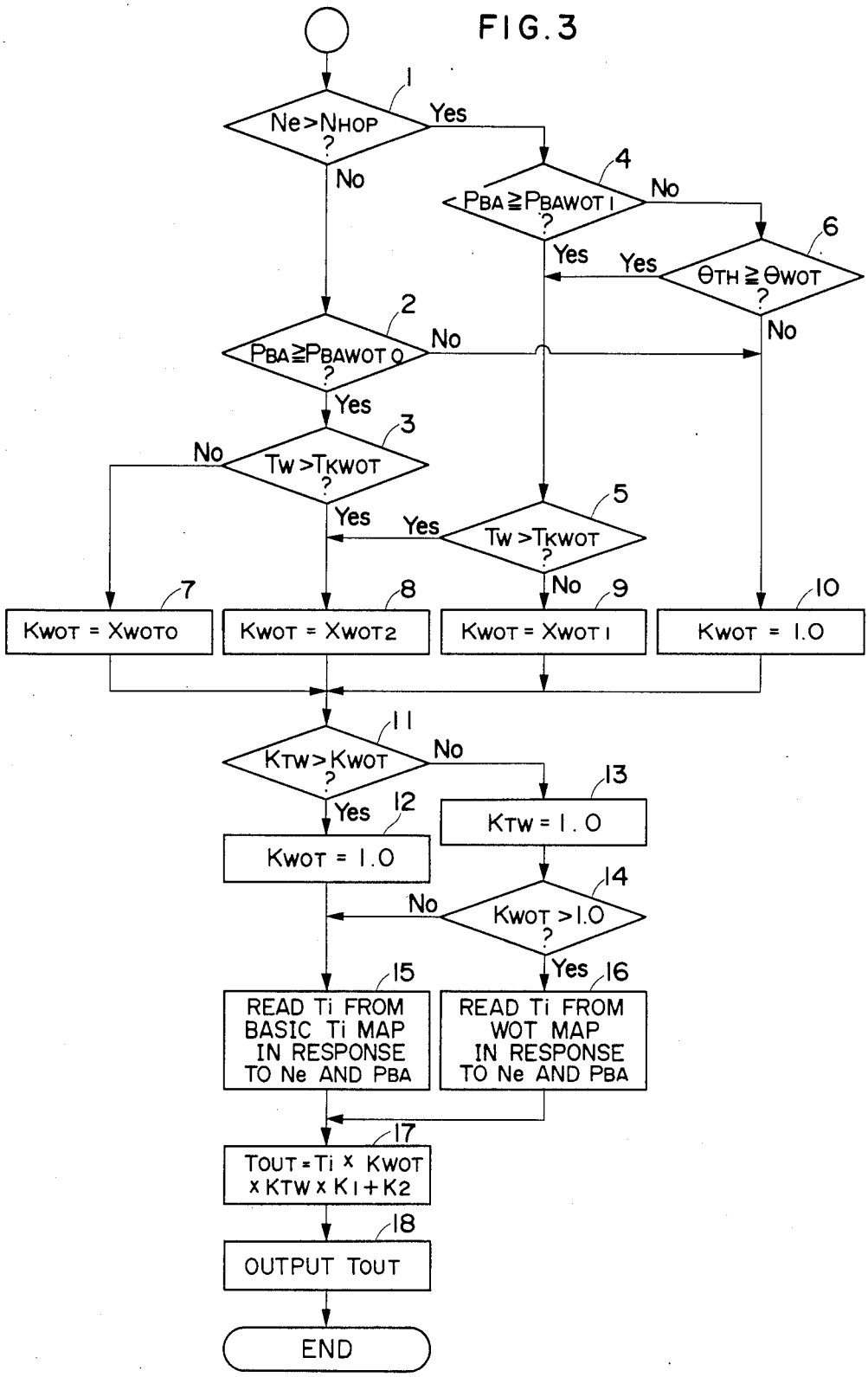
FIG. 3 is a flow chart showing a program for setting an enriching coefficient KWOT and the value opening period TOUT of fuel injection valves, according to the method of the invention.

FIG. 3 shows a manner of setting values of the enriching coefficient KWOT and the opening period TOUT of the fuel injection valves 6.

Figure 4:
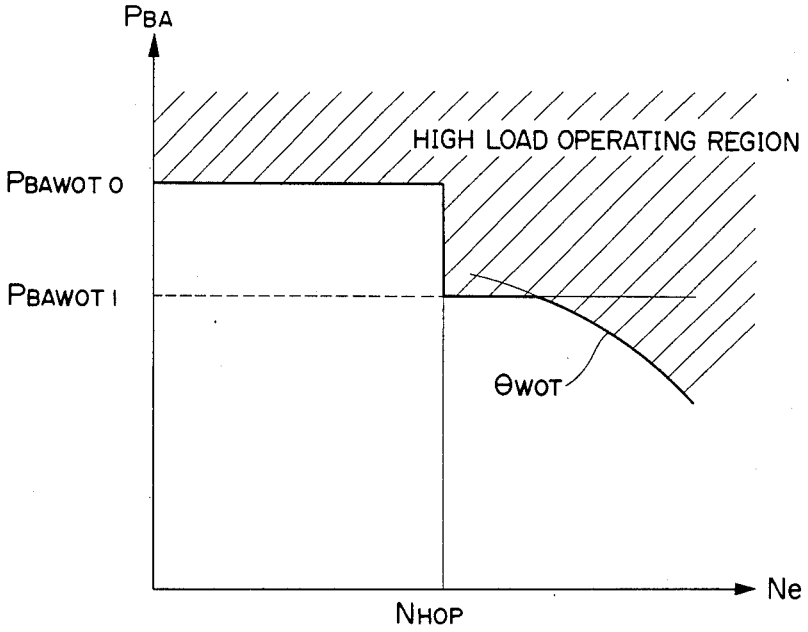
FIG. 4 is a graph showing high load operating regions of the engine.

First, at steps 1–10, it is determined whether or not the engine is in high load operating regions as shown in FIG. 4, and if the engine is in high load operatin regions, the value of the enriching coefficient KWOT is set to values corresponding to loaded conditions of the engine and the engine cooling water temperature.

More specifically, it is determined at step 1 whether or not the engine rotational speed Ne is higher than a predetermined value NHOP (e.g. 3000 rpm). If the answer is no, that is, if the engine rotational speed Ne is smaller than the predetermined value NHOP, it is then determined at step 2 whether or not the intake pipe absolute pressure PBA is higher than a predetermined value PBAWOTO (e.g. 710 mmHg). If the answer is no, that is, if the intake pipe absolute pressure PBA is smaller than the predetermined value PBAWOTO, it is determined that the engine is not operating in such a high load region where enrichment of the mixture is required, and the value of the mixture-enriching coefficient KWOT is set to 1.0 at step 10.

If the answer to the question of step 2 is yes, that is, if the intake pipe absolute pressue PBA is higher than the predetermined pressure value PBAWOTO, it is assumed that the engine is in such a high load region as mentioned above, and the program proceeds to step 3. It is determined at step 3 whether or not the engine cooling water temperature TW is higher than a predetermined value TKWOT (e.g. 100 ° C.). If the value of the engine water temperature TW is higher than the predetermined value TKWOT (if the answer is yes), it is assumed that the engine is operating in a low speed condition where engine knocking can easily occur, and then the value of the enriching coefficient KWOT is set to a value XWOT2 (e.g. 1.25) at step 8. If the value TW is lower than the value TKWOT (if the answer is no), it is assumed that the probability of occurrence of engine knocking is small, and then the value of the enriching coefficient KWOT is set to a value XWOT0 (e.g. 1.13) which is smaller than the value XWOT2, at step 7. The reason why the value of enriching coefficient KWOT is set to a larger value when the possibility of engine knocking is high lies in that part of the increased fuel quantity supplied into the engine cylinders absorbs more heat from overheated local portions of the inner surfaces of the engine cylinders when it evaporates, to cool the overheated local portions, resulting in prevention of engine knocking.

If the answer to the question of the aforementioned step 1 is yes, that is, if the engine rotational speed Ne is higher than the predetermined value NHOP, the program proceeds to step 4, wherein it is determined whether or not the intake pipd absolute pressure PBA is higher than a predetermined value PBAWOT1 (e.g. 690 mmHg). If the answer to the question of step 4 is yes, that is, if the intake pipe absolute pressure PBA is higher than the predetermined value PBAWOT1, it is determined that the engine is in such a high load region as mentioned before, and the program proceeds to step 5.

On the other hand, if the answer to the question of step 4 is no, the program proceeds to step 6, wherein it is determined whether or not the valve opening $\theta$th of the throttle valve 3 is larger than a predetermined value $\theta$WOT (e.g. 50 degrees). If the answer to the question of step 8 is no, that is, if the valve opening $\theta$th is smaller than the predetermined value $\theta$WOT, it is assumed that the engine is not in a high load condition, and the program proceeds to the aforementioned step 10, wherein the value of the enriching coefficient KWOT is set to the value 1.0. If the answer to the question of step 6 is yes, it is assumed that the engine is in a high load condition, and the program proceeds to the aforesaid step 5.

It is again determined at step 5 whether or not the engine cooling water temperature TW is higher than the predetermined value TKWOT as in step 3. If the answer is yes, that is, if the value TW is higher than the value TKWOT, the program proceeds to the aforementioned step 8, wherein the value of the enriching coefficient KWOT is set to the value XWOT2 (1.25). If the answer is no, the program proceeds to step 9, wherein the value of the enriching coefficient KWOT is set to a value XWOT1 (e.g. 1.18).

Figure 5:
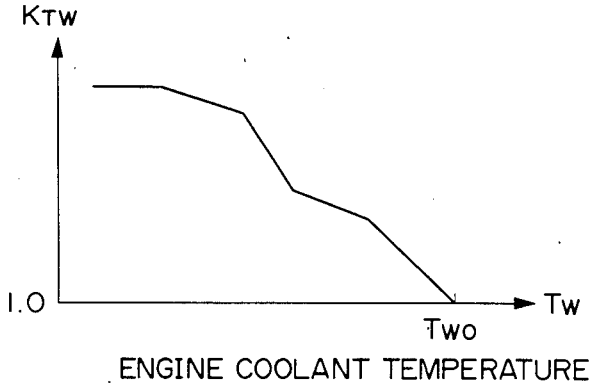
FIG. 5 is a graph showing the relationship between engine cooling water temperature TW and the value of a water temperature-dependent enriching coefficinet KTW.

After setting of the value of the enriching coefficient KWOT has been carried out at any one of the steps 7–10, the program than proceeds to step 11, wherein it is determined whether or not the value of the engine temperature-dependent enriching correction coefficient KTW employed in the aforementioned equation (1) is larger than the value of the enriching coefficient KWOT set as above. The enriching coefficient KTW is provided in order to increase the fuel supply quantity in response to the engine cooling water temperature TW. The value of the coefficient KTW is read from the KTW Table stored in the ROM 507 in FIG. 2. FIG. 5 shows the KTW Table, that is, the relationship between the cooling water temperature TW and the coefficient KTW. The KTW Table is set such that the value of the coefficient KTW to be read out decreases as the cooling water temperature TW increases, and the value KTW is set to a value 1.0 when the cooling water temperature TW is higher than a predetermined value TWO (e.g. 70 ° C.). According to the invention, steps 11–13 are provided to avoid overriching of the mixture due to simultaneous application of both the coefficient KTW and the coefficient KWOT at a low temperature, wherein only the larger one of the coefficients KTW and KWOT is actually applied to determine the valve opening period TOUT of the fuel injection valves 6 according to the aforementioned equation (1).

To be specific, if the answer to the question of step 11 is yes, that is, if the valve KTW is larger than the value KWOT, the program proceeds to step 12 wherein the coefficient KWOT is set to the value 1.0, followed by execution of step 15, hereinafter referred to. On the other hand, if the answer to the question of step 11 is no, the program proceeds to step 13 to set the coefficient KTW to the value 1.0, followed by execution of step 14.

It is determined at step 14 whether or not the coefficient KWOT is larger than the value 1.0. If the values of the coefficients KTW and KWOT are both 1.0, the steps 11 and 14 both provide a negative answer, the program proceeds to the step 15.

At step 15, a value T1ig of the basic valve opening period is determined, which corresponds to the engine rotational Ne and the intake pipe absolute pressure PBA, by the use of the basic Ti map applied during normal operation of the engine, shown in FIG. 6, and the basic value Ti of the equation (1) is set to the value T1ig thus determined. As noted before, the basic Ti map is stored in the ROM 507 in FIG. 2, wherein the T1ig values are set such that the air/fuel ratio obtained by application of the T1ig values may be equal to a theoretical air/fuel ratio (e.g. 14.7).

If the answer to the question of the step 14 is yes, it is assumed that the engine is in a high load operating condition, and the program proceeds to step 16. At step 16, the basic value Ti is set to a value T2ij of the basic valve opening period which corresponds to the values Ne and PBA and determined from the WOT map of FIG. 7 applied during high load operation of the engine. As noted before, the WOT map is also stored in the ROM 507 in FIG. 2 wherein the T1ig values are set such that the air/fuel ratio obtained by application of the T2ij values that may be smaller than the theoretical air/fuel ratio, e.g. approximately 12.0, in order to increase the output of the engine.

At step 17, the values Ti, KWOT, and KTW, determined as above are substituted into the aforementioned equation (1) together with the other coefficient and variable values to calculate the valve opening period TOUT of the fuel injection valve 6 and at step 18, a driving signal based on the calculated valve opening period TOUT is supplied to the fuel injection valve 6, to open same over the valve opening period TOUT to supply fuel to the engine, followed by termination of the program.

Incidentally, the predetermined values NHOP, PBAWOT0, PBAWOT1, θWOT and TKWOT employed at steps 1–6 for determining the KWOT value may be each provided with a hysteresis characteristic for stable control of the fuel supply to the engine. That is, each predetermined value may be set to different values between entrance into the high load region and departure therefrom.

What is claimed is:

1. A method of controlling the fuel quantity to be supplied to an internal combustion engine in response to operating conditions of said engine, comprising the steps of:

(1) storing beforehand a first group of basic fuel quantity values as a function of a first operation parameter of said engine including at least the rotational speed of said engine;

(2) storing beforehand a second group of basic fuel quantity values as a function of said first operation parameter of said engine, the basic fuel quantity values of said second group being each larger than a corresponding one of the basic fuel quantity values of said first group for the same value of said first operation parameter of said engine;

(3) detecting a value of said first operation parameter of said engine;

(4) detecting a value of the temperature of said engine;

(5) detecting a value of a second operation parameter of said engine indicative of load on said engine;

(6) determining from the detected value of said second operation parameter of said engine whether or not said engine is operating in a predetermined high load condition in which it is required to enrich an air/fuel mixture supplied to said engine;

(7) when it is detected that said engine is operating in said predetermined high load condition, (7-i) selecting one of said basic fuel quantity values of said second group that corresponds to the detected value of said first operation parameter of said engine, (7-ii) setting a value of a fuel increment on the basis of the detected value of the temperature of said engine and the detected value of said second operation parameter of said engine, (7-iii) correcting said one of said basic fuel quantity values of said second group selected in step (7-i) by the set value of said fuel increment to an increased value, (7-iv) setting a fuel quantity on the basis of said one of said basic fuel quantity values of said second group corrected in step (7-iii) to the increased value and supplying said set quantity to said engine; and (8) when it is determined in step (6) that said engine is operating in a condition other than said predetermined high load condition, (8-i) selecting one of said basic fuel quantity values of said first group that corresponds to the detected value of said first operation parameter of said engine, and (8-ii) setting a fuel quantity on the basis of said one of said basic fuel quantity values of said first group selected in step (8-i) and supplying the set quantity to said engine.

2. A method as claimed in claim 1, further including the steps of:

(9) setting a value of a second fuel increment on the basis of the detected value of the temperature of said engine;

(10) comparing the set value of said second fuel increment with the set value of said first mentioned fuel increment;

(11) when the set value of said second fuel increment is larger than the set value of said first mentioned fuel increment, (11-i) selecting one of said basic fuel quantity values of said first group that corresponds to the detected value of said first operation parameter of said engine even if it is determined in step (6) that said engine is operating in said predetermined high load condition, (11-ii) correcting said one of said basic fuel quantity values of said first group thus selected by the set value of said second fuel increment to an increased value, and (11-iii) setting a fuel quantity on the basis of said one of said fuel quantity values of said first group thus corrected to the increased value and supplying the set fuel quantity to said engine.

3. A method as claimed in claim 2, including the step of setting said first-mentioned fuel increment to such a value as does not increase the fuel quantity to be supplied to said engine, when said step (11-i) is executed.

4. A method as claimed in claim 1, wherein said engine has an intake passage, and a throttle valve arranged in said intake passage, said second operation parameter of said engine comprising at least one of the opening of said throttle valve and absolute pressure within said intake passage.

* * * * *